United States Patent [19]

Takahashi

[11] Patent Number: 4,584,263

[45] Date of Patent: Apr. 22, 1986

[54] PHOTOGRAPHIC LIGHT-SENSITIVE MATERIAL CONTAINING PARTICLES OF REDOX COMPOUND AND —COO— CONTAINING POLYMER

[75] Inventor: Osamu Takahashi, Kanagawa, Japan

[73] Assignee: Fuji Photo Film Co., Ltd., Kanagawa, Japan

[21] Appl. No.: 763,590

[22] Filed: Aug. 8, 1985

[30] Foreign Application Priority Data

Aug. 10, 1984 [JP] Japan ..... 59-167542

[51] Int. Cl.[4] ..... G03C 5/54; G03C 1/40; G03C 1/48; G03C 1/04

[52] U.S. Cl. ..... 430/533; 430/214; 430/215; 430/218; 430/222; 430/372; 430/536; 430/537; 430/551; 430/559; 430/627; 430/635

[58] Field of Search ..... 430/214, 215, 218, 222, 430/372, 551, 545, 559, 533, 536, 537, 635, 627

[56] References Cited

U.S. PATENT DOCUMENTS

| | | | |
|---|---|---|---|
| 4,366,236 | 12/1982 | Takahashi | 430/214 |
| 4,447,523 | 5/1984 | Ross et al. | 430/214 |
| 4,474,874 | 10/1984 | Hirano et al. | 430/372 |
| 4,525,451 | 6/1985 | Ohki et al. | 430/372 |
| 4,530,899 | 7/1985 | Ohki et al. | 430/372 |

OTHER PUBLICATIONS

"Photographic Processes and Products", *Research Disclosure* No. 15162, 11/1976, pp. 75–87.

*Primary Examiner*—Richard L. Schilling
*Attorney, Agent, or Firm*—Sughrue, Mion, Zinn, Macpeak & Seas

[57] ABSTRACT

A photographic light-sensitive material is described, comprising a support having thereon at least one combination of a silver halide photographic emulsion layer and associated therewith a dye-providing compound capable of imagewise forming a mobile dye as a result of imagewise light exposure and photographic development, said silver halide photographic emulsion layer or a layer containing said dye-providing compound having dispersed, in a hydrophilic colloid, a water-insoluble and organic solvent-soluble homopolymer or copolymer having as the main chain or a side chain thereof a repeating unit including a

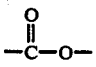

bond and a redox compound represented by formula (I) as combined paticles;

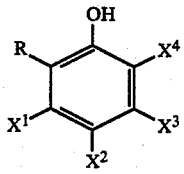

(I)

wherein R represents a hydrogen atom; a substituted or unsubstituted alkyl group, aryl group, acylamino group, alkoxy group, aryloxy group, alkylthio group, arylthio group, carbamoyl group, acyl group, alkoxycarbonyl group, aryloxycarbonyl group, sulfamoyl group, alkylsulfonyl group, or arylsulfonyl group; a halogen atom; a carboxy group; or a sulfonyl group; two of $X^1$, $X^2$, $X^3$, and $X^4$ represents members selected from the group consisting of a hydroxy group or a sulfonamido group having 1 or more carbon atoms, and the other two thereof each represents a member selected from the atoms and groups as defined above for R; or R and $X^1$ together form a carboncylic or heterocyclic group; and the total number of carbon atoms of R, $X^1$, $X^2$, $X^3$, and $X^4$ is sufficiently large to immobilize the redox compound in a hydrophilic colloid layer.

10 Claims, No Drawings

PHOTOGRAPHIC LIGHT-SENSITIVE MATERIAL CONTAINING PARTICLES OF REDOX COMPOUND AND —COO— CONTAINING POLYMER

FIELD OF THE INVENTION

This invention relates to a photographic light-sensitive material, in particular, a color photographic light-sensitive material. More specifically, the invention relates to a photographic light-sensitive material for a color diffusion transfer process having improved processing temperature latitude for achieving desired image density characteristics (in particular, the density characteristics of the gradation portion).

BACKGROUND OF THE INVENTION

In the technical field of photographic light-sensitive materials for color diffusion transfer process, various forms are known for integrated color diffusion transfer systems. For example, various forms are described in U.S. Pat. Nos. 3,415,644, 3,415,645, 3,415,646, 3,647,437, 3,635,707, and 3,756,815, and in Canadian Pat. Nos. 928,559 and 674,082. Other forms of color diffusion transfer systems, for example, so-called "peel apart" systems are described, for example, in U.S. Pat. Nos. 2,983,606, 3,362,819, and 3,362,821.

In diffusion transfer photographic systems, the development can not always be performed at a constant optimum temperature, and hence it has been desired to obtain a constant performance at a certain temperature range, usually from about 10° C. to about 35° C. Comparing development processing at low temperature and development processing at high temperature, it is noted the development proceeds at a higher speed and a larger amount of dyes are released in development processing at high temperature, which results in causing a great reduction in sensitivity and an increase of the maximum density (dmax).

As a technique for overcoming the above-described problems, for example, Japanese Patent Application (OPI) No. 74744/79 (the term "OPI" as used herein refers to a "published unexamined patent application") describes that the problem of "the reduction in sensitivity and the increase of Dmax at high-temperature processing" can be diminished by incorporating the hydroquinone ester derivative which is a precursor for a mobile hydroquinone in a timing layer or a layer disposed at the rear of the timing layer with respect to the spreading side of the processing solution, and releasing the mobile hydroquinone which is a competing developing agent at high temperature, whereby the hydroquinone diffuses into the light-sensitive emulsion layer(s). That is, by utilizing the property of the competing developing agent that it develops silver halide but does not release dyes, the above-described problem is solved.

However, in general, the use of mobile hydroquinones has the following serious disadvantages. That is, (1) since the hydroquinone itself and the decomposition products thereof diffuse into a mordanting or image-receiving layer, stains form in the layer, to greatly deteriorate the quality of image formed, and (2) the employment of the hydroquinone precursor cannot independently control only a particular layer among a blue-sensitive layer (B layer), a green-sensitive layer (G layer), and a red-sensitive layer (R layer) of a color photographic light-sensitive material. For example, if magenta only is intended to be controlled without changing yellow and cyan in the case of a multicolor photographic material, it still happens that the yellow and cyan are also changed. This is because since a mobile hydroquinone is diffusible, the hydroquinone diffuses into all the light-sensitive layers, i.e., all of the B layer, G layer, and R layer, and functions in all of these layers.

Also, it is described in *Research Disclosure,* Vol. 152, No. 15239 (published December 1976) that the processing temperature latitude is improved by a combination of the specific scavengers, i.e., didodecylhydroquinone and 4-amino-1-hydroxy-N-[α-2,4-di-t-aminophenoxybutyl]-2-naphthamide. However, the use of the combination of the specific scavengers is accompanied by the following disadvantages. That is, (1) since the activity of the scavenger is determined by the chemical structure of the specific scavenger for use, the freedom of the activity control is low, (2) it is impossible to independently control the processing temperature latitude of only a particular layer among the B layer, G layer, and R layer, and (3) the extent of the improvement of the processing temperature latitude is small.

SUMMARY OF THE INVENTION

An object of this invention, therefore, is to provide a photographic light-sensitive material having an improved processing temperature latitude for image density in only a particular desired silver halide emulsion layer.

As the result of extensive investigations, the inventors have discovered that the above-described object of this invention can be effectively attained by a photographic material comprising a support having thereon at least one combination of silver halide photographic emulsion layer having associated therewith a dye-providing compound capable of imagewise forming mobile dye as a result of imagewise light exposure and photographic development, said silver halide photographic emulsion layer or a layer containing said dye-providing compound having dispersed in a hydrophilic colloid a redox compound represented by formula (I) and a water-insoluble and organic solvent-soluble homopolymer or copolymer having as the main chain or a side chain thereof a repeating unit having a

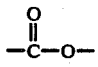

bond as combined particles thereof. The term "imagewise" used herein also implies the meaning of so-called "reverse-imagewise" according to kinds of silver halide used.

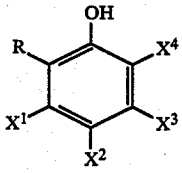

(I)

wherein R represents a hydrogen atom; a substituted or unsubstituted alkyl, aryl, acylamino, alkoxy, aryloxy, alkylthio, arylthio, carbamoyl, acyl, alkoxycarbonyl, aryloxycarbonyl, sulfamoyl, alkylsulfonyl, or arylsulfonyl group; a halogen atom; a carboxyl group, or a sulfon group; two of $X^1$, $X^2$, $X^3$, and $X^4$ represent members selected from the group consisting of a hydroxy group or a sulfonamido group having 1 or more carbon atoms, and the other two thereof each represents a group selected from the atoms and groups as defined above for R; or R and $X^1$ together form a carbocyclic or heterocyclic group; and the total number of carbon atoms of R, $X^1$, $X^2$, $X^3$, and $X^4$ is sufficiently large to immobilize the redox compound in a hydrophilic colloid layer.

Also, the redox compound represented by formula (I) for use in this invention preferably has a melting point of not more than 100° C., and, for example, it is preferred to use a mixture of at least two kinds of the redox compounds (including isomers) having similar chemical structures to each other.

The above-described dye-providing compound is also referred to hereinafter as the "coloring material".

DETAILED DESCRIPTION OF THE INVENTION

The mechanism whereby the processing temperature latitude is improved by the photographic light-sensitive material of this invention has not yet been clarified, but it appears that in the dispersion of particles the redox compound of formula (I) having a hydroxy group is influenced by the homopolymer or copolymer (hereinafter also referred to simply as the polymer) existing therewith, particularly with respect to the activity thereof for causing a reaction with the oxidation product of a developing agent. The cause is thought to be that the redox compound of formula (I) has a certain interaction with the polymer by hydrogen bonding or a hydrophobic bond, and the interaction becomes strong (accordingly, the redox compound is strongly protected by the polymer) at low temperature and becomes weak (accordingly, the redox compound becomes almost the state of ingle substance) at high temperature. That is, it appears that the redox compound of formula (I) competes with coloring material to weaken the extent of the activity of the coloring material for reacting with the oxidation product of a developing agent at low temperature, while the redox compound effectively reacts with excessive oxidation product of a developing agent at high temperature to thereby inactivate it. As a result thereof, the processing temperature reliance of the transferred dye density corresponding to the layer containing the dispersion of the redox compound and the polymer is decreased. That is, the processing temperature latitude can be enlarged. Also, in the photographic light sensitive material of this invention, the activity of the redox compound of formula (I) can be continuously and widely controlled by controlling the kind and amount of the polymer.

Also, U.S. Pat. No. 4,366,236 describes a color diffusion transfer photographic light-sensitive material wherein a hydroquinone derivative and the above-described polymer are dispersed in an interlayer thereof as the combined particles thereof. However, when these particles are dispersed in a so-called "interlayer", rather than in a silver halide emulsion layer or a coloring material-containing layer, there are problems, such as that the gradation at the toe portion of the photographic characteristic curve does not match in the layers of B, G, and R, or varies in a single layer according to the difference in processing temperature. On the other hand, in this invention, the gradation at the toe portion of the characteristic curve can be desirably matched.

Examples of the polymer (i.e., a water-insoluble and organic solvent-soluble homopolymer or copolymer having at the main chain or side chain thereof a repeating unit having a

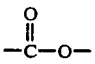

bond) for use in this invention are described in U.S. Pat. No. 4,366,236. For example, examples of these polymers used in this invention include (A) homopolymers and copolymers each having the repeating unit shown by the following formula

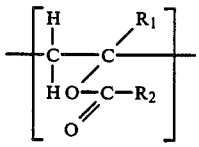

wherein $R_1$ represents hydrogen atom or an alkyl group (including a substituted alkyl group) and $R_2$ represents an alkyl group (including a substituted alkyl group) or an aryl group (including a substituted aryl group); (B) homopolymers and copolymers each having the repeating unit shown by the following formula

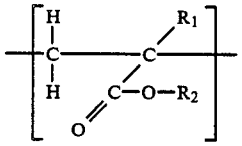

wherein $R_1$ and $R_2$ have the same significance as described in (A); (C) polyester obtained by the condensation of polyhydric alcohols and polybasic acids; and (D) polyesters having the following repeating unit

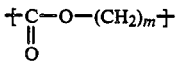

wherein m represents an integer of 4 to 7 and the chain —$CH_2$— may be a branched one, etc.

Specific examples of these polymers which are preferably used in this invention include (1) polyvinyl acetate,
(2) polyvinyl propionate,
(3) vinyl acetate-vinyl alcohol copolymer (90/10),
(4) polymethyl methacrylate,
(5) polyethyl acrylate,
(6) polyethyl methacrylate,
(7) polybutyl acrylate,
(8) polybutyl methacrylate,
(9) polyisobutyl methacrylate,
(10) polyisopropyl methacrylate,
(11) polyoctyl acrylate,
(12) butyl acrylate-acrylamide copolymer (95/5),
(13) stearyl methacrylate-acrylic acid copolymer (90/10),
(14) 1,4-butanediol-adipic acid polyester,
(15) ethylene glycol-sebacic acid polyester,
(16) polycaprolactone,
(17) polypropiolactone, and
(18) polydimethylpropiolactone.

Also, these polymers may be used solely or as a mixture thereof.

Preferred redox compounds represented by formula (I):

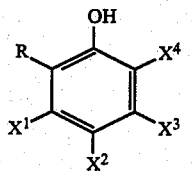

(I)

include those wherein R represents a hydrogen atom; a substituted or unsubstituted alkyl group (preferably having from 1 to 30 carbon atoms, such as pentadecyl group, a (sec)-octadecyl group, etc.), aryl group (preferably having from 6 to 30 carbon atoms, such as a phenyl group, a tolyl group, etc.), acylamino group (preferably having from 2 to 30 carbon atoms, such as an acetylamino group, a dodecanamido group, etc.), alkoxy group (preferably having from 1 to 30 carbon atoms, such as a methoxy group, an octyloxy group, etc.), aryloxy group (preferably having from 6 to 30 carbon atoms, such as a phenoxy group, a 4-(t)-octylphenoxy group, etc.), alkylthio group (preferably having from 1 to 30 carbon atoms, such as an octylthio group, a dodecylthio group, etc.), arylthio group (preferably having from 6 to 30 carbon atoms, such as a phenylthio group, a 4-(t)-octylphenylthio group, etc.), carbamoyl group (preferably having from 1 to 40 carbon atoms, such as an N-octadecylcarbamoyl group, an N,N-dioctadecylcarbamoyl group, etc.), acyl group (preferably having from 2 to 40 carbon atoms, such as an acetyl group, a pentadecyl carbonyl group, a 4-dodecylbenzenecarbonyl group, etc.), alkoxycarbonyl group (preferably having from 2 to 40 carbon atoms, such as a methoxycarbonyl group, a decyloxycarbonyl group, etc.), aryloxycarbonyl group (preferably having from 7 to 40 carbon atoms, such as a phenoxycarbonyl group, a 4-(t)-butylphenoxycarbonyl group, etc.), sulfamoyl group (preferably having up to 40 carbon atoms, such as an N-phenylsulfamoyl group, an N-octylsulfamoyl group, etc.), alkyl or arylsulfonyl group (preferably having from 1 to 40 carbon atoms, such as an octanesulfonyl group, a benzenesulfonyl group, etc.); a halogen atom (e.g., a chlorine atom, a bromine atom, etc.); a carboxy group; or a sulfonyl group.

Two of $X^1$, $X^2$, $X^3$, and $X^4$ represent members selected from the group consisting of a hydroxy group or a sulfonamido group having 1 or more carbon atoms (preferably alkyl or arylsulfonamido group having from 1 to 40 carbon atoms, and the alkyl group and aryl group may further be substituted, with examples thereof including a methansulfonamido group, a benzenesulfonamido group, a 4-dodecyloxybenzenesulfonamido group, 4-octadecyloxysulfonamido group, a 4-dodecylbenzenesulfonamido group, etc.) and the other two thereof each represents a member selected from the atoms and groups as defined above for R. Said R and $X^1$ may also together form a carbocyclic or heterocyclic group.

The carbocyclic and heterocyclic groups are preferably 5-membered or 6-membered groups, and these groups may be saturated or unsaturated. It is preferred that the hetero atom forming the heterocyclic ring be N, O, or S. Also, the ring may have one or more substituents.

Examples of the above-described various groups represented by R, $X^1$, $X^2$, $X^3$, and $X^4$ or examples of the substituent for the carbon ring or a heterocyclic ring formed by the combination of R and $X^1$ are an alkyl group, an aryl group, an acylamino group, an alkoxy group, an aryloxy group, an alkylthio group, an arylthio group, a carbamoyl group, an acyl group, an alkoxycarbonyl group, an aryloxycarbonyl group, a sulfamoyl group, an alkylsulfonyl group, an arylsulfonyl group, a hydroxy group, an amino group, an alkylsulfonamido group, an arylsulfonamido group, a carboxyl group, and a sulfon group.

The total number of carbon atom of R, $X^1$, $X^2$, $X^3$, and $X^4$ preferred in order to always sufficiently immobilize the redox compound according to this invention in a hydrophilic colloid layer is preferably not less than 10.

Specific examples of the redox compound represented by formula (I) are illustrated below, but the invention is not limited to these compounds.

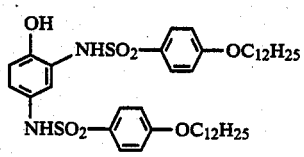

(1)

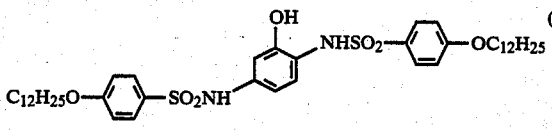

(2)

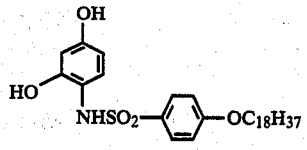

(3)

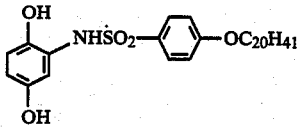

(4)

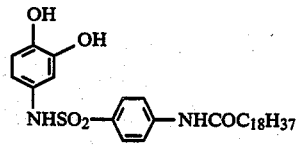

(5)

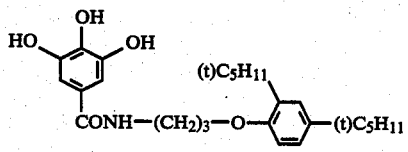

(6)

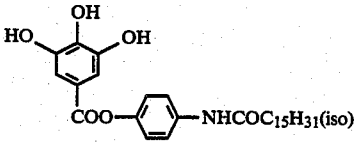

(7)

-continued (8)

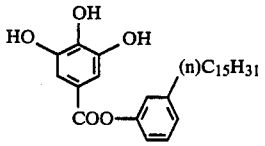

(9)

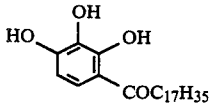

(10)

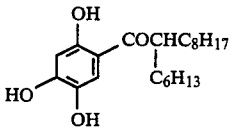

(11)

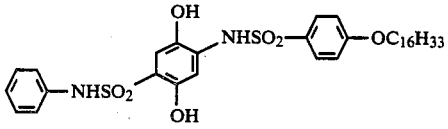

(12)

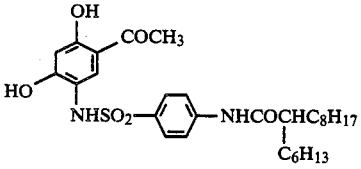

(13)

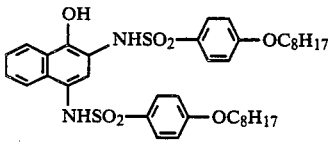

(14)

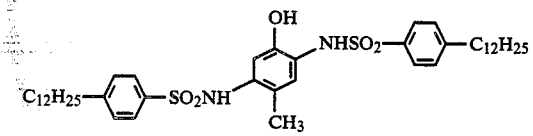

(15)

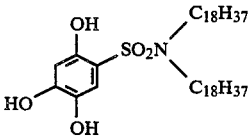

(16)

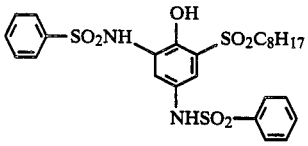

(17)

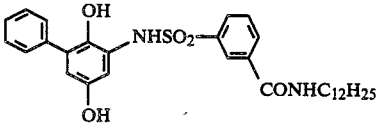

(18)

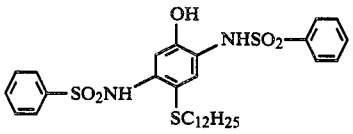

-continued (19)

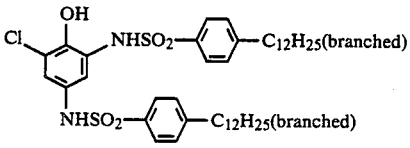

(20)

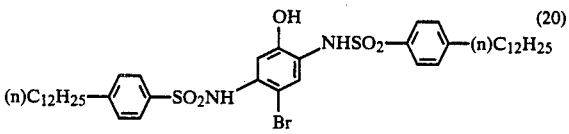

(21)

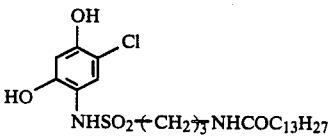

(22)

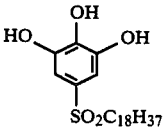

(23)

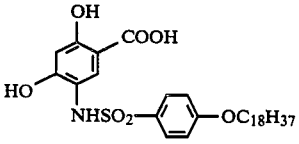

(24)

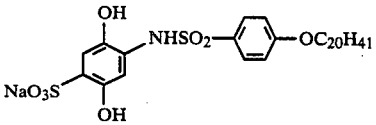

The compounds of formula (I) can be prepared according to synthesis examples described in Japanese Patent Application (OPI) Nos. 72158/80, 17431/83, 156933/83, 5247/84, Japanese Patent Application Nos. 68878/83, 78606/83, West German Pat. No. 2,732,971, etc., or a manner analogous to such synthesis examples.

The above-described compounds can be used as a mixture thereof for the purpose of reducing the melting point. Also, a high-boiling organic solvent which is ordinarily used as a solvent for coloring material may be used together with the above compound as a third component.

In a preferred step of preparing the dispersion of particles of the redox compound and the polymer in a body, the redox compound and the polymer are dissolved in a low-boiling solvent (e.g., ethyl acetate), the solution is added to an aqueous solution of a hydrophilic colloid, and the mixture is emulsified using an emulsifying device such as a homogenizer, etc., to provide the emulsion or dispersion.

By coating a silver halide emulsion or an emulsion of a coloring material containing the above-described emulsion or dispersion on a support followed by drying, the desired photographic light-sensitive material of this invention can be obtained.

There is no particular restriction on the amount of the redox compound used according to this invention, but the redox compound of formula (I) is preferably used in an amount of from about 0.01 to 0.1 millimole/$m^2$. There is also no particular restriction about the amount of the polymer, but it is preferable that the amount of the polymer is from about 0.1/1 to 30/1, and more preferably from 6/1 to 12/1, by weight ratio, with respect to the amount of the redox compound of formula (I).

As the hydrophilic colloid for use in this invention, gelatin is particularly useful, but other hydrophilic colloids which are used for photographic light-sensitive materials can also be used in this invention.

As the low-boiling solvent for dissolving the redox compound and the polymer, solvents having a boiling point of lower than 100° C. are preferably used, and among them, ethyl acetate, methyl ethyl ketone, etc., are particularly preferred, since such an solvent can be easily removed during a drying step after coating.

The photographic light-sensitive materials of this invention can be preferably applied to color diffusion transfer processes, but can also be applied other photographic process, such as heat developing type color photographic process. Details of the latter type of the photographic light-sensitive materials are described, e.g., in European Pat. No. 76,492 A2 (Japanese Patent Application (OPI) No. 58543/83).

The light-sensitive silver halide emulsion for use in this invention is a hydrophilic colloid dispersion of silver chloride, silver bromide, silver chlorobromide, silver iodobromide, silver chloroiodobromide, or a mixture thereof. The halogen composition is selected according to the intended purpose of the photographic materials and processing conditions for the photographic materials, but silver bromide or silver iodobromide or silver chloroiodobromide having an iodine content of less than 10 mole% and a chlorine content of less than 30 mole% are particularly preferred.

The silver halide emulsion for use in this invention may be of a negative type forming surface latent images or of a direct reversal type. Examples of the latter type emulsion include internal latent image type emulsions and pre-fogged direct reversal type emulsions.

In the case of applying this invention to a color diffusion transfer process, an internal latent image type direct reversal silver halide emulsion is advantageously used. Examples of the silver emulsion are conversion type silver halide emulsions, core/shell type silver halide emulsions, silver halide emulsions containing foreign metals, etc., as described, for example, in U.S. Pat. Nos. 2,592,250, 3,206,313, 3,447,927, 3,761,276, 3,935,014, etc.

Examples of nucleating agent for this type of emulsion include hydrazines as described in U.S. Pat. Nos. 2,588,982, 2,563,785, etc.; hydrazides and hydrazones as described in U.S. Pat. No. 3,227,552; quaternary salt compounds as described in U.K. Pat. No. 1,283,835, Japanese Patent Publication No. 38164/74, U.S. Pat. Nos. 4,115,122, 3,734,738, 3,719,494, 3,615,615, etc.; sensitizing dyes containing a substituent having a fogging (nucleating) action in the dye molecule as described in U.S. Pat. No. 3,718,470; thiourea linked type acylhydrazine series compounds as described in U.S. Pat. Nos. 4,030,925, 4,031,127, 4,245,037, 4,255,511, 4,266,013, 4,276,364, etc., and urea-type acrylhydraxine series compounds as described in U.S. Pat. No. 4,374,923, etc.

Coloring materials for use in this invention include, for example, redox compounds of a mobile dye releasing type (hereinafter referred to as "DRR" compounds) and couplers, as well as dye developing agents. In these coloring materilas, DRR compounds are preferably used. When the diffusibility of the DRR compound itself is considerably lower than that of the diffusible dye released from the DRR compound, the DRR compound may be mobile to some extent.

The invention is further explained below by exemplifying the case of using DRR compounds.

When the photographic light-sensitive materials of this invention are used for a non-peel-apart type color diffusion transfer process, it is preferred that the DRR compound is immobile under an alkaline processing condition and is represented by formula (II)

(Ballast)-(Link)-(Dye) (II)

wherein, (Ballast) is a ballast group for immobilizing the DRR compound under an alkaline processing condition; (Dye) is a dye group or precursor thereof capable of moving in a photographic layer under at least an alkaline processing condition, and (Link) is a cleavage group (negative type) which is cleaved by oxidation occuring by development, or by a redox cleavage group (positive type) having a property of controlling the occurrence of cleavage.

Negative type Link groups are described for example, in U.S. Pat. Nos. 4,135,929, 4,053,312, 4,336,322, Japanese Patent Application (OPI) Nos. 33826/73, 104343/76, 46730/78, 130122/79, 113624/76, 12642/81, 161131/81, 4043/82, 650/82, 20735/82, 54021/79, 71072/81, etc. Specific examples are set forth below, but the invention is not limited to these groups. In addition, Link as described above can be an N-substituted sulfamoyl group (the substituent of which is preferably an aryl group) as shown below.

Examples of (Ballast)-(Link) releasing a mobile dye are as follows.

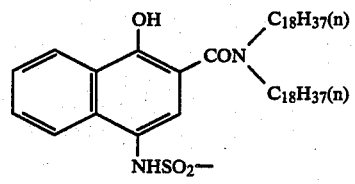

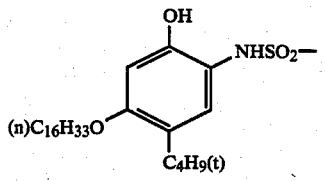

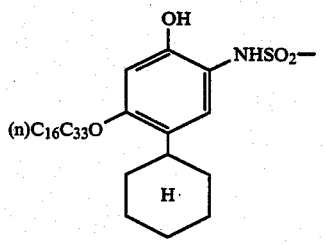

-continued

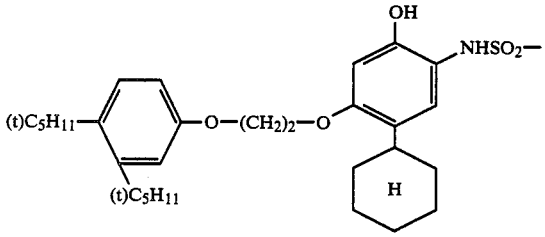

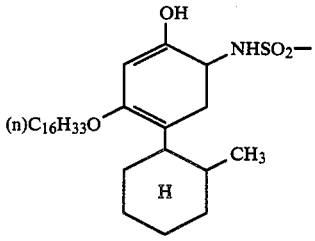

On the other hand, positive type Link groups are described, for example, in U.S. Pat. Nos. 4,199,354, 4,199,355, 4,139,379, 4,139,389, 3,719,489, and 4,098,783, Japanese Patent Application (OPI) Nos. 111628/74, 63618/76, 69033/78, 130927/79, 164342/81, and 4819/77, Japanese Patent Application No. 60289/83, etc. Specific examples of the particularly preferred positive Link groups are shown below, but the invention is not limited to these groups.

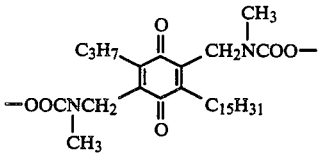

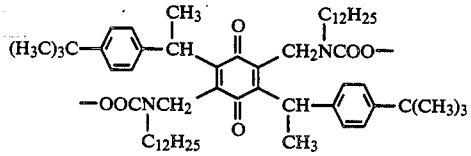

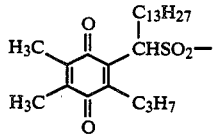

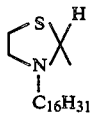

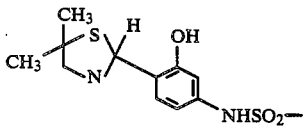

It is known that in these positive-type dye-providing compounds, the compound of a type capable of releasing a dye by reduction, such as a quinone skeleton, is used as a combination with a diffusion resisting electron donative compound (well known as an ED compound) or a precursor thereof and examples of the ED compounds are described, for example, in U.S. Pat. Nos. 4,263,393, 4,278,750; Japanese Patent Application (OPI) No. 138736/81.

Also, the positive-type DRR compound may be a compound of a type containing an electron donative moiety in the molecule and releasing a dye by an intramolecular oxidation reaction.

The dye released from the DRR compound may be a dye itself or a dye precursor which can be converted into a dye in a photographic processing step or an addition processing step and the dye of the final image may be metal unchelated or chelated.

Examples of the typical dyes are metal chelated or unchelated azo dyes, azomethine dyes, anthraquinone dyes, phthalocyanine dyes, etc. Of these dyes, azoic cyan, magenta and yellow dyes are particularly preferred in this invention.

Examples of yellow dyes for use in this invention are described in U.S. Pat. Nos. 3,597,200, 3,309,199, 4,013,633, 4,245,028, 4,156,609, 4,139,383, 4,195,992, 4,148,641, 4,148,643, and 4,336,322, Japanese Patent Application (OPI) Nos. 114930/76 and 71072/81, and in *Research Disclosure,* RD No. 17630 (1978), ibid., RD No. 16475 (1977), etc.

Examples of magenta couplers are described in U.S. Pat. Nos. 3,453,107, 3,544,545, 3,932,380, 3,931,144, 3,932,308, 3,954,476, 4,233,237, 4,255,509, 4,250,246, 4,142,891, 4,207,104, and 4,287,292, Japanese Patent Application (OPI) Nos. 106727/77, 23628/78, 36804/80, 73057/81, 71060/81, 134/80, etc.

Examples of cyan dyes are described in U.S. Pat. Nos. 3,482,972, 3,929,760, 4,013,635, 4,268,625, 4,171,220, 4,242,435, 4,142,891, 4,195,994, 4,147,544, 4,148,642, U.K. Pat. No. 1,551,138; Japanese Patent Application (OPI) Nos. 99431/79, 8827/77, 47823/78, 143323/78, 99431/79, and 71061/81, European Patent (EPC) Nos. 53,037 and 53,040, and *Research Disclosure,* RD No. 17630 (1978), ibid., RD No. 16475 (1977), etc.

Also, as one kind of dye precursor, a DRR compound having a dye moiety whose light absorption is temporarily shifted in a light-sensitive silver halide emulsion layer can be used in this invention. Specific examples of these DRR compounds are described in Japanese Patent Application (OPI) Nos. 53330/80, 53329/80, U.S. Pat. Nos. 3,336,287, 3,579,334, and 3,982,946, U.K. Pat. No. 1,467,317, etc.

The coating amount of the DRR compound is generally from $1\times10^{-4}$ to $10^{-2}$ mole/m$^2$, and preferably from $2\times10^{-4}$ to $2\times10^{-3}$ mole/m$^2$.

For the reproduction of natural color by a subtractive color photographic process, a photographic light-sensitive material having at least two combinations each of a silver halide emulsion having a selective spectral sensitivity at a certain wavelength region and a DRR compound having a selective spectral absorption at the save wavelength region or a different wave length region is used.

In particular, in the case of applying this invention to a color diffusion transfer process, a photographic light-sensitive material having a combination of a blue-sensitive silver halide emulsion and a yellow DRR compound, a combination of a green-sensitive silver halide emulsion and a magenta DRR compound, and a combination of a red-sensitive silver halide emulsion and a cyan DRR compound, is useful. These combination units of silver halide emulsions and DRR compounds may be coated in layers with face-to-face relation in a photographic light-sensitive material or may be coated in one layer as particles thereof.

The image-receiving element (including at least a mordanting layer), a neutralizing layer, a neutralization speed controlling layer (timing layer), a reflective layer, a light-shielding layer, a cover sheet, etc., for use in combination with the photographic light-sensitive material of this are described, for example, in Japanese Patent Application (OPI) No. 64533/77.

A polymer mordant which is used for the mordanting layer is a polymer containing a secondary or tertiary amino group, a copolymer having a nitrogen-containing heterocyclic moiety, or a polymer containing a quaternary cation group and the molecular weight of the polymer is higher than 5,000, preferably higher than 10,000.

When the photographic light-sensitive material of this invention is used for a color diffusion transfer process, a silver halide developing agent which is used for processing the photographic light-sensitive material may be any silver halide developing agent if the oxidation product of the developing agent can cross-oxidize the DRR compound. As such a developing agent, a color developing agent may be used but a black and white developing agent, e.g., a 3-pyrazolidone, etc., is preferably used.

In a preferred embodiment of the photographic light-sensitive material of this invention, an image-receiving layer, a light reflective layer capable of substantially shielding light (for example, a combination of a $TiO_2$ layer and a carbon black layer), and a silver halide photographic emulsion layer having associated therewith a DRR compound are formed on a transparent support and a transparent cover sheet is disposed thereof in a face-to-face relation.

A pressure rupturable pod containing an alkaline processing solution containing an opacifying agent (e.g., carbon black) for light shielding is disposed adjacent to the uppermost layer of the above-described silver halide photographic emulsion layer (protective layer) and the transparent cover sheet.

Such a film unit having the above-described construction is image-exposed through a transparent cover sheet, the pod is ruptured by a pressure-applying member while pulling the film unit out from the camera to spread the alkaline processing solution over the space between the light-sensitive layer and the cover sheet, whereby the light-sensitive silver halide photographic emulsion layer is shielded in a sandwiched form, and development proceeds in the dark.

It is preferred that the photographic light-sensitive material of this invention has a neutralization mechanism and in particular, it is preferred to form a neutralizing layer on the cover sheet (if desired, it is formed on the side of the timing layer to be spread with the processing solution).

Also, in the above-described embodiment of this invention, after completing the transferred image, the portion (color print) including the image-receiving layer may be separated from the portion including the light-sensitive silver halide emulsion layer, or may not be separated therefrom.

Also, in another embodiment of this invention, the film unit may be so composed that the processing solution is spread between an image-receiving sheet having a mordanting layer on a support (having, preferably, a neutralizing mechanism) and a light-sensitive sheet having a light-sensitive silver halide emulsion layer and a coloring material-containing layer on another support (including a so-called peel-apart type and a non-peel-apart type).

The following examples are intended to illustrate the present invention, but not to limit it in any way.

EXAMPLE 1

(1) A control light-sensitive sheet (A) was prepared by coating, in succession, the following layers on a polyethylene terephthalate film support.

(1) Mordanting layer containing 3.0 g/m$^2$ of copoly[styrene-N-vinylbenzyl-N,N,N-trihexylammonium chloride] and 3.0 g/m$^2$ of gelatin.

(2) Light-reflective layer containing 20 g/m$^2$ of titanium dioxide and 2.0 g/m$^2$ of gelatin.

(3) Light-shielding layer containing 3.0 g/m$^2$ of carbon black and 2.0 g/m$^2$ of gelatin.

(4) Layer containing 0.44 g/m$^2$ of the cyan dye releasing redox compound having the structure shown below, 0.09 g/m$^2$ of tricyclohexyl phosphate, and 0.8 g/m$^2$ of gelatin.

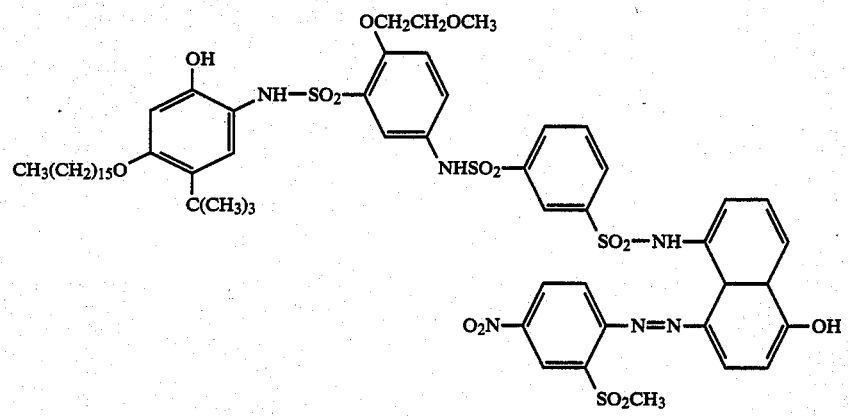

(5) Layer containing a red-sensitive internal latent image type direct reversal silver bromide emulsion (1.03 g/m$^2$ as silver amount, and 1.2 g/m$^2$ of gelatin), 0.06 mg/m$^2$ of a nucleating agent having the structure shown below, and 0.07 g/m$^2$ of 2-sulfo-5-n-pentadecylhydroquinone sodium salt.

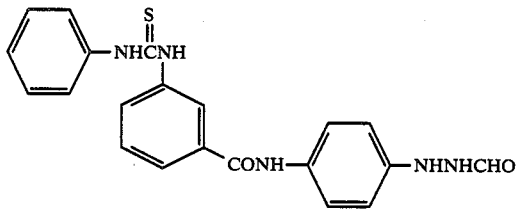

(6) Interlayer containing 0.8 g/m$^2$ of gelatin, 1.0 g/m$^2$ of 2,5-di-t-pentadecylhydroquinone, and 1.0 g/m$^2$ of polymethyl methacrylate (color mixing preventing agent-containing layer).

(7) Layer containing 0.21 g/m$^2$ of the magenta dye releasing redox compound having following structural formula A, 0.11 g/m$^2$ of the magenta-dye-releasing redox compound shown by following structural formula B, 0.08 g/m$^2$ of tricyclohexyl phosphate, and 1.8 g/m$^2$ of gelatin.

Structural formula A

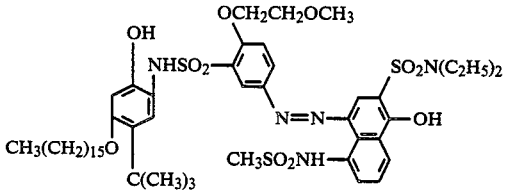

Structural formula B

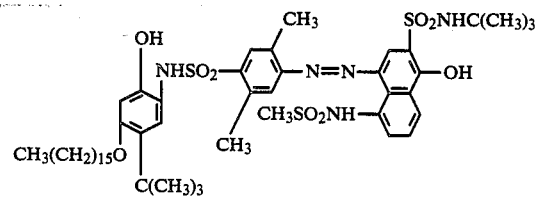

(8) Layer containing a green-sensitive internal latent image type direct reversal silver bromide emulsion (0.91 g/m$^2$ as silver amount, 1.4 g/m$^2$ of gelatin), 0.04 g/m$^2$ of the nucleating agent as in layer (5), and 0.05 g/m$^2$ of 2-sulfo-5-n-pentadecylhydroquinone sodium salt.

(9) Interlayer containing 0.8 g/m$^2$ of gelatin, 1.0 g/m$^2$ of 2,5-di-t-pentadecylhydroquinone, and 1.0 g/m$^2$ of polymethyl methacrylate (color mixing preventing agent-containing layer).

(10) Layer containing 0.02 g/m$^2$ of the yellow dye releasing redox compound having the structural formula shown below, 0.16 g/m$^2$ of tricyclohexyl phosphate, and 0.8 g/m$^2$ of gelatin.

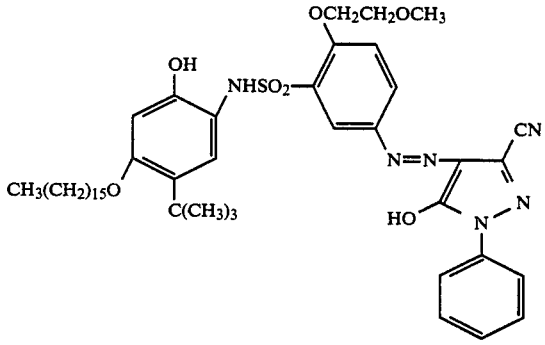

(11) Layer containing a blue-sensitive internal latent image type direct reversal silver bromide emulsion (1.09 g/m$^2$ as silver amount, 1.1 g/m$^2$ of gelatin), 0.04 mg/m$^2$ of the nucleating agent as in layer (5), and 0.06 g/m$^2$ of 2-sulfo-5-n-pentadecylhydroquinone sodium salt.

(12) Layer containing 1.0 g/m$^2$ of gelatin.

The following three kinds of gelatin emulsions having the following component weight ratios were prepared in the manner described above.

Emulsion (1): Redox compound (7) only.

Emulsion (2): Redox compound (7)/polyvinyl acetate=1/12.

Emulsion (3): Redox compound (7)/polymethyl methacrylate=1/12.

By adding the above-described emulsion to the following layer of the light-sensitive sheet as described above, light sensitive sheets (B) to (G), as described below, were prepared.

Light-sensitive sheet (B): Emulsion (1) was added to layer (7) containing magenta dye releasing redox compound (that is, the light-sensitive sheet was prepared by the same procesure as in the case of preparing light-sensitive sheet (A) except that redox compound (7) was added to the coating composition for layer (7) so that the coverage of the redox compound became 0.1 g/m$^2$).

Light-sensitive sheet (C): Emulsion (2) was added to layer (7) containing magenta dye releasing redox compound (that is, the light-sensitive sheet was prepared by the same procedure as in the case of preparing light-sensitive sheet (A) except that redox compound (7) and polyvinyl acetate were added to the coating composition for layer (7) so that the coverages thereof became 0.1 g/m$^2$ and 1.2 g/m$^2$, respectively).

Light-sensitive sheet (D): Emulsion (2) was added to layer (4) containing cyan dye releasing redox compound (that is, the light-sensitive sheet was prepared by the same procedure as in the case of preparing light-sensitive sheet (A) except that redox compound (7) and polyvinyl acetate were added to the coating composition for layer (4) so that the coverages thereof became 0.08 g/m$^2$ and 0.96 g/m$^2$, respectively).

Light-sensitive sheet (E): Emulsion (2) was added to layer (10) containing yellow dye releasing redox compound (that is, the light-sensitive sheet was prepared by the same procedure as in the case of preparing light-sensitive sheet (A) except that redox compound (7) and polyvinyl acetate were added to the coating composition for layer (10) so that the coverages thereof became 0.06 g/m$^2$ and 0.72 g/m$^2$, respectively).

Light-sensitive sheet (F): Emulsion (2) was added to green-sensitive emulsion layer (8) (that is, the light-sensitive sheet was prepared by the same procedure as in the case of preparing light-sensitive sheet (A) except that redox compound (7) and polyvinyl acetate were added to the coating composition for layer (8) so that the coverages thereof became 0.05 g/m$^2$ and 0.6 g/m$^2$, respectively).

Light-sensitive sheet (G): Emulsion (3) was added to green-sensitive emulsion layer (8) (that is, the light-sensitive sheet was prepared by the same procedure as in the case of preparing light-sensitive sheet (A) except that redox compound (7) and polymethyl methacrylate were added the coating composition for layer (8) so that the coverages there of became 0.05 g/m$^2$ and 0.6 g/m$^2$, respectively.

(2) Preparation of cover sheet:

A cover sheet was prepared by coating, in succession, the following layers (1') to (3') on a transparent polyester support.

(1') Layer containing 22 g/m$^2$ of a copolymer of acryl acid and butyl aceryate of 80/20 by weight ratio and 0.44 g/m$^2$ of 1,4-bis(2,3-epoxypropoxy)-butane.

(2') Layer containing 3.8 g/m$^2$ of acetyl cellulose (forming 39.5 g of acetyl group by the hydrolysis of 100 g of the acetyl cellulose), 0.2 g/m$^2$ of a copolymer (having a molecular weight of about 50,000) of styrene and maleic anhydride of 60/40 by weight ratio, and 0.115 g/m$^2$ of 5-($\beta$-cyanoethylthio)-1-phenyltetrazole.

(3') Layer containing 2.5 g/m$^2$ of a copolymer latex of vinylidene chloride, methyl acrylate, and acrylic acid of 85/12/3 by weight ratio, and 0.05 g/m$^2$ of a polymethyl methacrylate latex (particle size of 1 to 3 $\mu$m).

(3) Composition of processing composition:

| | |
|---|---|
| 1-p-Tolyl-4-hydroxymethyl-4-methyl-3-pyrazolidinone | 12 g |
| Methylhydroquinone | 0.3 g |
| 5-Methylbenzotriazole | 3.5 g |
| Sodium sulfite (anhydrous) | 0.2 g |
| Carboxymethyl cellulose Na salt | 43 g |
| Potassium hydroxide | 56 g |
| Benzyl alcohol | 1.5 ml |
| Carbon black | 150 g |
| Water to make | 1 kg |

Each of above-described light-sensitive sheets (A) to (G) was imagewise exposed through a continuous wedge to tungsten light of 2854° K., converted into light of 4800° K. through a Davis-Gibson filter (in this case, the maximum exposure amount was 10 CMS).

Each of the light-sensitive sheets thus light exposed was integrated with a container containing the above-described processing composition and the above-described cover sheet and the container was ruptured by means of pressure to spread the processing liquid thereover at 15° C. or 35° C.

One day later, the transferred dye density was measured by means of a color densitometer. The results thus obtained are shown in Table 1.

TABLE I

| | logE (difference between 15° C. and 35° C.)*1 | | |
|---|---|---|---|
| | B*2 | G*2 | R*2 |
| Comparison Example A | −0.20 | −0.35 | −0.25 |
| Comparison Example B | −0.20 | −0.32 | −0.23 |
| Example of the Invention C | −0.20 | −0.11 | −0.24 |
| Example of the Invention D | −0.20 | −0.32 | −0.10 |

TABLE I-continued

| | logE (difference between 15° C. and 35° C.)*1 | | |
|---|---|---|---|
| | B*2 | G*2 | R*2 |
| Example of the Invention E | −0.08 | −0.31 | −0.25 |
| Example of the Invention F | −0.20 | −0.12 | −0.23 |
| Example of the Invention G | −0.20 | −0.16 | −0.24 |

*1: Value obtained by subtracting the value at 35° C. from the value at 15° C.
*2: Measured at a point of density 0.70

From the results shown in Table 1, it can be seen that by using the emulsion of this invention, the difference of logE in the case of processing the layer containing the emulsion at 15° C. and 35° C. can be greatly reduced without substantially influencing the photographic properties of other photographic layers. That is, by using the emulsion of this invention, the processing temperature latitude can be enlarged.

While the invention has been described in detail and with reference to specific embodiments thereof, it will be apparent to one skilled in the art that various changes and modifications can be made therein without departing from the spirit and scope thereof.

What is claimed is:

1. A photographic light-sensitive material comprising a support having thereon at least one combination of a silver halide photographic emulsion layer and associated therewith a dye-providing compound capable of imagewise forming a mobile dye as a result of imagewise light exposure and photographic development, said silver halide photographic emulsion layer or a layer containing said dye-providing compound having dispersed, in a hydrophilic colloid a water-insoluble and organic solvent-soluble homopolymer or copolymer having as the main chain or a side chain thereof a repeating unit including a

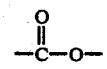

bond and a redox compound represented by formula (I) as combined particles;

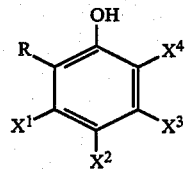

(I)

wherein R represents a hydrogen atom; a substituted or unsubstituted alkyl group, aryl group, acylamino group, alkoxy group, aryloxy group, alkylthio group, arylthio group, carbamoyl group, acyl group, alkoxycarbonyl group, aryloxycarbonyl group, sulfamoyl group, alkylsulfonyl group, or arylsulfonyl group; a halogen atom; a carboxy group; or a sulfon group; two of $X^1$, $X^2$, $X^3$, and $X^4$ represent members selected from the group consisting of a hydroxy group or a sulfonamido group having 1 or more carbon atoms, and the other two thereof each represents a member selected from the atoms and group as defined above for R; or R and $X^1$ together form a carbocyclic or heterocyclic group; and the total number of carbon atoms of R, $X^1$, $X^2$, $X^3$, and $X^4$ is sufficiently large to immobilize the redox compound in a hydrophilic colloid layer.

2. A photographic light-sensitive material as in claim 1, wherein the total number of carbon atoms of R, $X^1$, $X^2$, $X^3$, and $X^4$ is not less than 10.

3. A photographic light-sensitive material as in claim 1, wherein the compound represented by formula (I) has a melting point of not more than 100° C.

4. A photographic light-sensitive material as in claim 1, wherein the compound of formula (I) is used in an amount of from 0.01 to 0.1 millimole/$m^2$.

5. A photographic light-sensitive material as in claim 4, wherein the amount of the homopolymer or copolymer is from about 0.1/1 to 30/1, by weight ratio, with respect to the amount of the compound of formula (I).

6. A photographic light-sensitive material as in claim 4, wherein the amount of the homopolymer or copolymer is from 6/1 to 12/1, by weight ratio, with respect to the amount of the compound of formula (I).

7. A photographic light-sensitive material as in claim 1, wherein R represents a hydrogen atom, a substituted or unsubstituted alkyl group having 1 to 30 carbon atoms, aryl group having 6 to 30 carbon atoms, acylamino group having 2 to 30 carbon atoms, alkoxy group having 1 to 30 carbon atoms, aryloxy group having 6 to 30 carbon atoms, alkylthio group having 1 to 30 carbon atoms, arylthio group having 6 to 30 carbon atoms, carbamoyl group having 1 to 40 carbon atoms, acyl group having 2 to 40 carbon atoms, alkoxycarbonyl group having 2 to 40 carbon atoms, aryloxycarbonyl group having 7 to 40 carbon atoms, sulfamoyl group having up to 40 carbon atoms, alkyl or arylsulfonyl group having 1 to 40 carbon atoms; a halogen atom; a carboxy group or a sulfon group.

8. A photographic light-sensitive material as in claim 1, wherein the carbocyclic or heterocyclic group formed by $X^1$ and R is a saturated or unsaturated 5- or 6-membered ring group.

9. A photographic light-sensitive material as in claim 1, wherein any one of the groups represented by R, $X^1$, $X^2$, $X^3$ and $X^4$ or the carbocyclic or heterocyclic group formed by R and $X^1$ is substituted with a substituent selected from a group consisting of an alkyl group, an aryl group, an acylamino group, an alkoxy group, an aryloxy group, an alkylthio group, an arylthio group, a carbamoyl group, an acyl group, an alkoxycarbonyl group, an aryloxycarbonyl group, a sulfamoyl group, an alkyl or arylsulfonyl group, a hydroxyl group, an amino group, an alkyl or arylsulfonamido group, a carboxyl group and a sulfon group.

10. A photographic light-sensitive material as in claim 1, wherein the water-insoluble and organic solvent-soluble homopolymer or copolymer having as the main chain or a side chain thereof a repeating unit including

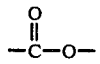

bond is selected from (A) homopolymers and copolymers each having the repeating unit shown by the following formula

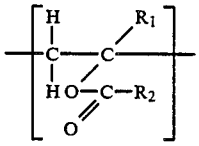

wherein $R_1$ represents hydrogen atom or an alkyl group (including a substituted alkyl group) and $R_2$ represents an alkyl group (including a substituted alkyl group) or an aryl group (including a substituted aryl group); (B) homopolymers and copolymers each having the repeating unit shown by the following formula

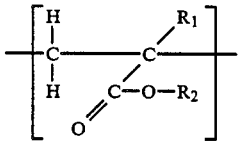

wherein $R_1$ and $R_2$ have the same significance as described in (A); (C) polyester obtained by the condensation of polyhydric alcohols and polybasic acids; and (D) polyesters having the following repeating unit

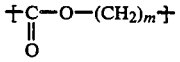

wherein m represents an integer of 4 to 7 and the chain —$CH_2$— may be a branched one.

* * * * *